US007514193B2

(12) United States Patent
Nagahama et al.

(10) Patent No.: US 7,514,193 B2
(45) Date of Patent: Apr. 7, 2009

(54) DEVELOPING TONER FOR ELECTROSTATIC LATENT IMAGES, IMAGING FORMING METHOD AND IMAGE FORMING APPARATUS

(75) Inventors: Hitoshi Nagahama, Uji (JP); Tatsuo Imafuku, Nara (JP); Takahiro Bito, Nara (JP); Tenjiku Eiji, Nara (JP); Takeshi Satoh, Yamatokoriyama (JP); Ohkawa Takeshi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

(21) Appl. No.: 11/090,001

(22) Filed: Mar. 28, 2005

(65) Prior Publication Data

US 2005/0221214 A1 Oct. 6, 2005

(30) Foreign Application Priority Data

Mar. 31, 2004 (JP) ..... P2004-107506

(51) Int. Cl.
*G03G 9/087* (2006.01)

(52) U.S. Cl. ..... 430/108.1; 430/108.7; 430/109.4

(58) Field of Classification Search ..... 430/108.1, 430/108.7, 109.4
See application file for complete search history.

(56) References Cited

U.S. PATENT DOCUMENTS

| | | | | |
|---|---|---|---|---|
| 5,478,686 | A * | 12/1995 | Kawakami et al. | 430/109.4 |
| 6,566,025 | B1 * | 5/2003 | McStravick et al. | 430/108.11 |
| 6,939,653 | B2 * | 9/2005 | Suzuki et al. | 430/108.4 |
| 2003/0165760 | A1 | 9/2003 | Higuchi et al. | |
| 2006/0269860 | A1 * | 11/2006 | Nanya et al. | 430/109.4 |
| 2006/0275680 | A1 * | 12/2006 | Miyakawa | 430/45 |
| 2007/0020546 | A1 * | 1/2007 | Emoto et al. | 430/108.22 |
| 2008/0032226 | A1 * | 2/2008 | Sugiyama et al. | 430/135 |

FOREIGN PATENT DOCUMENTS

| | | | |
|---|---|---|---|
| JP | 59-129863 | | 7/1984 |
| JP | 60-93456 | A | 5/1985 |
| JP | 6-3854 | | 1/1994 |
| JP | 2000-267350 | A | 9/2000 |
| JP | 2000-321819 | A | 11/2000 |
| JP | 2001-134009 | | 5/2001 |
| JP | 2001134007 | * | 5/2001 |
| JP | 2003-255588 | A | 9/2003 |

OTHER PUBLICATIONS

Abstract of JP 2001134007.*
English language machine translation of JP 2001134007.*
English language abstract of JP 2001-125307, May 11, 2001.

* cited by examiner

*Primary Examiner*—Hoa V Le
(74) *Attorney, Agent, or Firm*—Nixon & Vanderhye, P.C.

(57) ABSTRACT

Provided is a developing toner for electrostatic latent images capable of coping with the size reduction of an image forming apparatus and decrease of the consumption amount, not shortening the working life of a photoreceptor, less causing paper jam, background fogging, etc., excellent in various characteristics required for the toner, and capable of forming images of good picture quality. The developing toner being used when images are formed to a recording material in an image forming apparatus comprising an image forming station, a recording material feeding station, an image fixing station and a controlling station, the developing toner for electrostatic latent images containing hydrophobic fluidizing particles deposited to the surface of coloring resin particles comprising a binder resin containing a polyester resin, a polyalkylene, a polyolefin dispersant and a non-oxidized polyethylene resin, and an inorganic pigment, and having time constant $\tau$ of from 100 to 350 msec.

6 Claims, 2 Drawing Sheets

DEVELOPING TONER FOR ELECTROSTATIC LATENT IMAGES, IMAGING FORMING METHOD AND IMAGE FORMING APPARATUS

BACKGROUND OF THE INVENTION

1. Field of the Invention

The present invention relates to a developing toner for electrostatic latent images, an imaging forming method and an image forming apparatus.

2. Description of the Related Art

Electrophotographic image forming apparatus such as copying machines, printers and facsimiles are adopted to form electrostatic latent images by various image forming processes on photoreceptors, then develop the electrostatic latent images by a toner supplied from a developing device into toner images, transfer the toner images to a recording material and then fix them by heating and pressing rollers thereby obtaining images. As a photoreceptor, an organic photoreceptor having a photoconducting layer containing an organic polymeric compound and a conductive material has been used generally in view of high safety in the manufacturing process, high safety to environments, and reduced material cost.

Since the electrophotographic image forming apparatus are easy for operation and maintenance and can form images having good picture quality at a relatively high speed, they are apparatus indispensable in various cases. Recently, reduction of the size has been progressed further with an aim of space saving. Correspondingly, reduction of the size has been demanded further for the constituent devises inside the image forming apparatus, for example, a light sensitive body, plural devices arranged at the periphery thereof and a toner containing vessel.

For the image forming apparatus, in addition to the size reduction, it is demanded to increase the image forming speed and increase the number of sheets capable of forming images per shot of the toner to be filled. While increase in the number of sheets capable of forming images can be attained by increasing the capacity of the toner containing vessel, since there is a conflicting demand of reducing the size of the apparatus on the other hand, it is not possible to simply increase the capacity. Accordingly, it is demanded to contain a more amount of the toner in the size-reduced toner containing vessel than usual, or to decrease the amount of the toner consumed per cycle of image formation. For this purpose, it may be considered to reduce the size of toner particles while enhancing the hiding power of the toner on a recording material. However, as the size of the diameter of toner particles is decreased, the triboelectric charging amount of individual toners is lowered and the toner scatters from a developing machine upon developing electrostatic latent images to contaminate the inside of the image forming apparatus. Furthermore, as the triboelectrical charging amount of the toner lowers, since the Van der Walls force between toner particles increases to cause agglomeration of toners, no uniform toner images can be formed on electrostatic latent images to cause image failure. Furthermore, background fogging of deposition of the toner to a portion other than the portion for electrostatic latent images also occurs remarkably to extremely increase the toner consumption amount. Furthermore, upon transfer of toner images on the photoreceptor, blotting of character images (phenomenon of toner scattering at the periphery of character images), trailing (phenomenon of toner deposition, like trailing, to the rear end of character images) etc. also occur.

Furthermore, in a case of forming images by using a toner, oxides for improving the toner flowability such as silicon dioxide, titanium oxide or aluminum oxide is added to the toner. Furthermore, in a case of use as a magnetic toner, an inorganic magnetic material is used together. Such oxides and inorganic magnetic materials have a property of grinding the photoconducting layer of an organic photoreceptor drum. Accordingly, the photoconducting layer is gradually ground into a thin layer in the process of repeating image formation. As a result, the residual potential in the photoconducting layer increases to often cause failure of picture quality such as background fogging, increase of the line width for fine line images and, in addition, this shortens the working life of the organic photoreceptor drum. In view of the situations described above, it has been proposed to use a metal oxide power with a weight average grain size of 0.6 to 5 μm, a number average grain size of 0.5 to 4 μm and a weight average grain size/number average grain size ratio of 1.0 to 2.4 as the toner fluidizing agent instead of the oxides described above (for example refer to Japanese Patent Publication JP-A 6-3854(1994)). While the metal oxide powder is effective for ensuring the toner flowability, it shows high grinding property and has the same defect of shortening the working life of an organic photoreceptor drum as that of existent oxides or inorganic magnetic materials.

On the other hand, as a binder resin which is a matrix for carrying a colorant, a polyester resin is used generally in the toner. By the use of the polyester resin, the toner can be fixed at a relatively lower temperature to a recording material. Furthermore, since the polyester resin has such a triboelectric chargeability as required for the toner, it has an advantage capable of preventing filming in which a toner is deposited not to the recording material but to the photoreceptor. However, the toner using the polyester resin as the binder resin involves a drawback of causing a so-cold offset phenomenon in which the toner is deposited to heating and pressing rolls in a case of fixing toner images on the recording material by the heating and pressing rolls. Then, waxes are added as an anti-offsetting agent. The waxes include, for example, non-polar low molecular weight polyolefin, teflon (registered trademark) resin and paraffin. However, since the anti-offsetting agents described above have less compatibility with the polyester resin, they can not prevent the occurrence of the offset phenomenon sufficiently. In addition, the anti-offsetting agent is present as it is in the toner and a portion thereof is fused to a photoreceptor or deposited to a carrier used together with the toner, making the toner chargeability not uniform and causing the phenomenon like filming.

Furthermore, for improving the hiding power of the toner, it is extremely important to control the grain size and the deposition amount of the wax deposited on the surface of toner particles. In a case where a great amount of wax particles are present on the surface of the toner particles, they make it difficult to provide triboelectric charges to the toner, thus makes it difficult to obtain a desired triboelectriccally charged amount of the toner, and increase the toner particles with less charged amount and, thus, tending to cause disadvantages such as toner scattering or background fogging. Furthermore, in a case where the deposition amount of the wax particles on the surface of the toner particles is excessively small, this naturally tends to cause the offset phenomenon and deteriorates the fixing property of the toner to the recording material.

In a developing toner for electrostatic latent images containing a polyester resin as a binder resin, use of an oxidized type polyolefin with an acid value of 1 or more in which an unsaturated carboxylic aid is graft polymerized to a polyolefin resin as an anti-offsetting agent has been proposed (for example refer to Japanese Unexamined Patent Publication JP-A 59-129863(1984)). In the invention disclosed in JP-A 59-129863, since the oxidized type polyolefin having a polarity is added to a polyester resin having polarity by nature, compatibility between both of them is enhanced and fusion of the oxidized type polyolefin to a photoreceptor and deposition thereof to a carrier can be avoided reliably. Furthermore, the oxidized type polyolefin is effective also for the prevention of the offset phenomenon. However, since a general combination of a polyester resin and an oxidized type polyolefin shows excessively high compatibility and the oxidized polyolefin is dispersed excessively as fine particles, high lubricity inherent to the oxidized type polyolefin can not be provided sufficiently. As a result, releasability between the heating and pressing rollers and paper as the recording material is insufficient. Particularly, in a case where solid black images are present at the top end of the images, this results in a problem of causing paper jam in the image forming apparatus. Furthermore, since the toner is poor in slidability on the surface of solid black images after fixing, so-called fixing property to scratching, it results in a problem of back transfer or back contamination in which recording materials are rubbed to each other and the toner on the surface of the recording material is deposited to the surface opposite to the image forming surface of the recording material upon stacking several sheets of recording materials on which images are formed and manually turning back them for inspection.

SUMMARY OF THE INVENTION

The invention intends to provide a developing toner for electrostatic latent images, excellent in store stability and flowability even in a size-reduced toner containing vessel, showing good transferability and fixing property to a recording material, not shortening the working life of an organic photoreceptor drum, consuming extremely less toner per cycle of image formation and capable of forming images at a high picture quality.

The invention provides a developing toner for electrostatic latent images comprising coloring resin particles containing a binder resin and an inorganic pigment; and hydrophobic fluidizing particles deposited on surfaces of the coloring resin particles, the binder resin containing a polyester resin, a polyalkylene, a polyolefin dispersant and a non-oxidized polyethylene resin, in which the polyolefin dispersant is a polyolefin dispersant selected from a graft polymer formed by graft polymerizing a styrenic polymer chain or styrene (meth)acrylic polymer chain to a polyolefin resin, and a styrene (meth)acrylic polymer, and a time constant $\tau$ of the toner being from 100 to 350 msec (100 msec or more and 350 msec or less).

In the invention it is preferable that the polyester resin has an acid value of from 15 to 30 mg KOH/g (15 mg KOH/g or more and 30 mg KOH/g or less) and a hydroxyl value of from 4 to 17 mg KOH/g (4 mg KOH or more and 17 mg KOH or less).

In the invention it is preferable that the polyester resin has a glass transition temperature of from 55 to 65° C.

In the invention it is preferable that the polyester resin has a melt index of from 0.1 to 6.0 g/10 min (0.1 g/10 min or more and 6.0 g/10 min or less).

In the invention it is preferable that the inorganic pigment is a carbon black, which is contained in the coloring resin particles at a ratio of from 5 to 20 parts by weight (5 parts by weight or more and 20 parts by weight or less) based on 100 parts by weight of the polyester resin.

In the invention it is preferable that the polyalkylene is contained in the coloring resin particles at a ratio from 0.2 to 20 parts by weight (0.2 parts by weight or more and 20 parts by weight or less) based on 100 parts by weight of the polyester resin.

In the invention it is preferable that the non-oxidized polyesthylene is contained in the coloring resin particles at a ratio from 0.5 to 5.0 parts by weight (0.5 parts by weight or more and 5.0 parts by weight or less) based on 100 parts by weight of the polyester resin.

In the invention it is preferable that the hydrophobic fluidizing particle is a hydrophobic silica having a specific surface area of from 90 to 240 $m^2/g$ (90 $m^2/g$ or more and 240 $m^2/g$ or less).

In the invention it is preferable that the hydrophobic fluidizing particles are mixed by from 0.1 to 3.0 parts by weight (0.1 parts by weight or more and 3.0 parts by weight or less) based on 100 parts by weight of the coloring resin particles.

Furthermore, the invention provides an image forming method comprising using the above-mentioned developing toners for electrostatic latent images described above and recording images by an electrophotographic method to a recording material.

Furthermore, the invention provides an image forming apparatus in which the above-mentioned developing toner for electrostatic latent images is used and images are recorded to a recording material by an electrophotographic method.

According to the invention, in the developing toner for electrostatic latent images in which the surface of the coloring resin particles containing the binder resin and the inorganic pigment is covered with the hydrophobic fluidizing particles, a mixture of the polyester resin, the polyalkylene, the specified polyolefin dispersant having the styrene polymer chain or styrene-(meth)acrylic polymer chain and the non-oxidized polyethylene resin is used as a binder resin. Since such a mixture is used as a binder resin, the non-oxidized polyethylene resin can be dispersed uniformly as particles of an adequate size of 1 μm or less in the binder resin. As a result, poor compatibility between the polyester resin and the polyalkylene which can not be solved by the mere addition of the polyolefin dispersant is improved, and particles of the polyalkylene are moderately dispersed in the polyester resin and deposited also to the surface of the toner particles to such an extent as to provide a sufficient triboelectrically-charged amount with the toner and not to deteriorate the anti-offsetting property, the transferability and the fixing property, so that a desired developing toner for electrostatic latent images can be obtained.

The developing toner for electrostatic latent images according to the invention provides the following effects (1) to (4) based on that the polyalkylene particles are moderately dispersed uniformly in the polyester resin as the main ingredient of the binder resin.

(1) Since the toner is excellent in the store stability, does not cause fusion (blocking), agglomeration, deformation, etc. even in a size-reduced toner containing vessel and is also excellent in the flowability, supply of the toner to the electrostatic latent images can be conducted uniformly and smoothly over a long period of time.

(2) The toner has good transferability and fixing property to the recording material and causes less filming to the photoreceptor, offsetting to the heating and pressing rollers (fixing roller), etc.

(3) The toner has less grinding effect to the photoconducting layer of the organic photoreceptor and does not wastefully shorten the working life of the organic photoreceptor. In addition, since the consumption amount per cycle of image formation is extremely small, more amount of images can be formed than usual by one shot of filling to the image forming apparatus even when the size of the toner containing vessel is reduced.

(4) While the toner according to the invention can be prepared to a grain size, preferably, of from 3 to 15 μm and, more preferably, from 5 to 8 μm, it may also be formed into a smaller size from about 3 to 5 μm, without deteriorating various performances required for the toner.

Further, by the use of the constitution described above, the developing toner for electrostatic latent images according to the invention has a moderately high rate for the rising of charge with the time constant τ in a range from 100 to 350 msec. Accordingly, since the toner has sufficient triboelectric chargeability even when the size of the toner is reduced, it does not scatter in the image forming apparatus, is free from the occurrence of blur of characters, tailing, background fogging, etc. and can also prevent paper jam or the like. Accordingly, by the use of the developing toner for electrostatic latent images according to the invention, images of excellent transferring property and fixing property, as well as having a sufficient image density and a high picture quality can be formed efficiently.

Furthermore, according to the invention, among the polyester resins described above, those having an acid value of from 15 to 30 mg KOH/g and a hydroxyl value of from 4 to 17 mg KOH/g are preferred. The anti-offsetting property and the negative charge stability of the toner according to the invention are further improved by controlling the acid value of the polyester resin to the range described above. Furthermore, the toner of the invention shows a stable chargeability even under high temperature and high humidity circumstances.

According to the invention, among the polyester resins described above, those having a glass transition temperature of 55 to 65° C. are preferred. The anti-blocking property, the anti-offsetting property and the anti-filming property, etc. are further improved by the use of the polyester resin described above.

According to the invention, among the polyester resins described above, those having the melt index of from 0.1 to 6.0 g/10 min are preferred. Since compatibility with the polyalkylene as the wax ingredient is further improved and the polyalkylene is dispersed uniformly in the polyester resin by the use of the polyester resin, various characteristics of the toner according to the invention are further improved.

According to the invention, the time constant in the invention can be controlled extremely easily within a desired range by using the carbon black as the inorganic pigment and defining the amount of use thereof to 5 to 20 parts by weight based on 100 parts by weight of the polyester resin.

According to the invention, the addition effect of the polyalkylene can be provided most efficiently by defining the amount of use thereof to 0.2 to 20 parts by weight based on 100 parts by weight of the polyester resin with no various troubles caused by the presence of the polyalkylene.

According to the invention, when the amount of using the non-oxidized polyethylene is from 0.5 to 5.0 parts by weight based on 100 parts by weight of the polyester resin, the addition effect can be provided most efficiently.

According to the invention, hydrophobic silica with the specific surface area of from 90 to 240 $m^2/g$ is preferred among the hydrophobic fluidizing particles described above. Even in a case where the size of the toner according to the invention is decreased, preferable flowability can be ensured by using the hydrophobic silica.

According to the invention, the effect of providing the flowability to the toner can be obtained more remarkably by using the hydrophobic fluidizing particles by from 0.1 to 3.0 parts by weight based 100 parts by weight of the coloring resin particles.

Further, according to the invention, an electrophotographic image forming method and an image forming apparatus using the developing toner for electrostatic latent images of the invention described above are provided.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
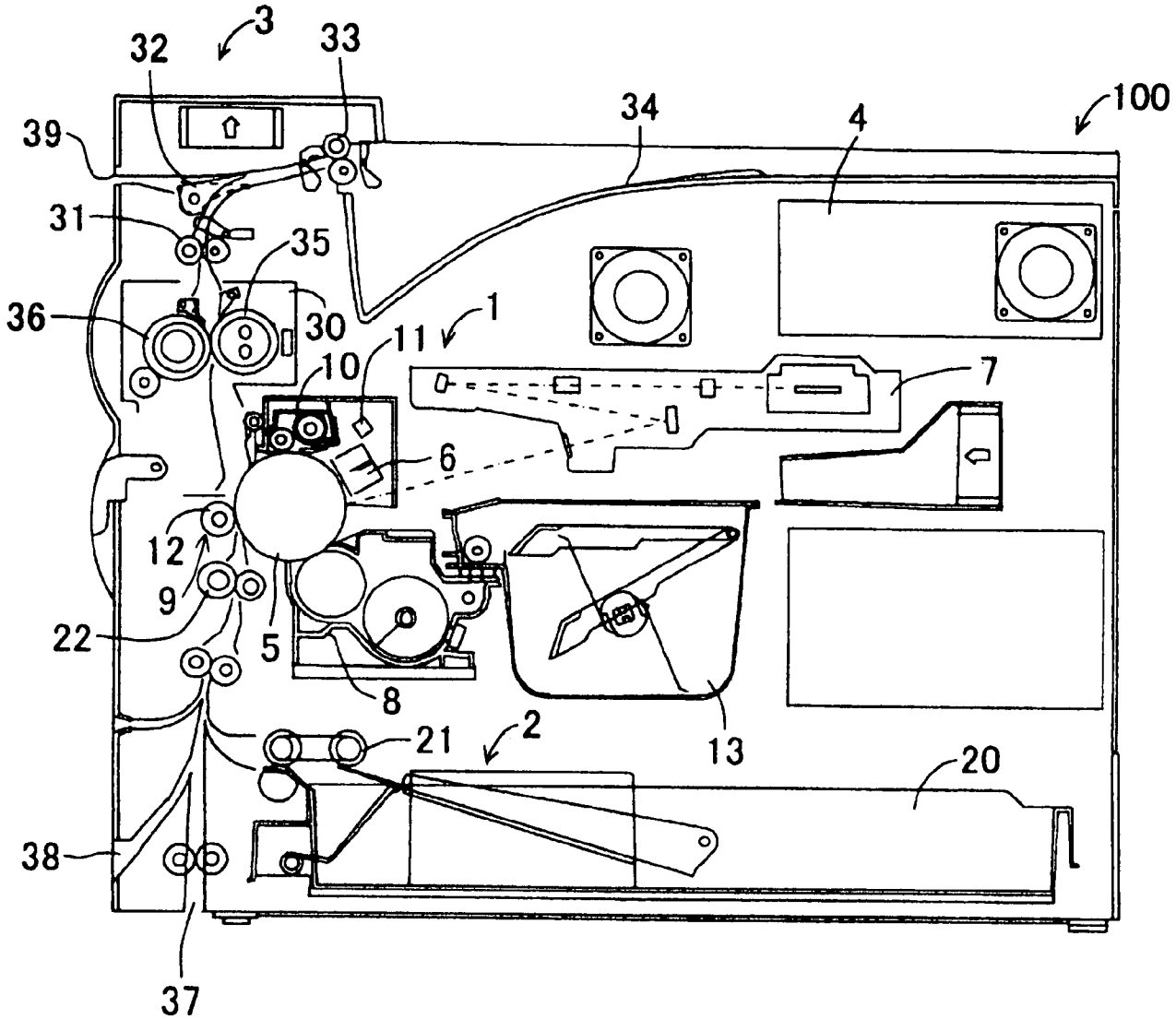
FIG. 1 is a cross sectional view schematically showing the constitution for a main portion of an image forming apparatus according to a first embodiment of the invention.

Now referring to the drawings, preferred embodiments of the invention are described below.

The developing toner for electrostatic latent images according to the invention has a feature in that, hydrophobic fluidizing particles are deposited on the surface of the coloring resin particles and the time constant τ thereof is from 100 to 350 msec.

The developing toner for electrostatic latent images according to the invention has a time constant τ of preferably from 100 to 350 msec. The time constant τ is a physical property as an index showing the time that required for the toner to be charged and, in a case where the toner has the time constant within the range described above, the time for charging the toner, that is, a so-called charge rising time is moderately accelerated and scattering of the toner from the developing device and background fogging in the non-image portion can be prevented sufficiently. In a case where the time constant τ is less than 100 msec, while the rising speed of the charging increases, the fixing property tends to be lowered. On the other hand, if it exceeds 350 msec, rising of charging is lowered to possibly cause the scattering of the toner and the background fogging.

Since the toner is a dielectric material, it has a resistor ingredient and a static capacitor (condenser) ingredient together. Assuming the resistance of the toner as R (Ω) and the static capacitance of the toner as C (F), the state in which a voltage is applied to the toner can be regarded as a circuit in which a resister at R (Ω) and a static capacitor at C (F) are connected in series. It is assumed that a direct current voltage E (V) is applied to the series circuit, the instance of applying the voltage E is time 0, the currant flowing through the circuit at time t is i(t) (A), and the electric charges accumulated in the capacitor is q(t) (C, coulomb). The equation for the circuit in this case is as shown below:

$$E=R\cdot i(t)+q(t)/C \tag{1}$$

Since the current is a flow of electrons, that is, a magnitude for the change with time of the amount of charges, it is expressed as: i(t)=dq(t)/dt and the equation (1) can be rewritten into the following differential equation for the electric charges q(t):

$$E=R\cdot dq(t)/dt+q(t)/C \tag{2}$$

When the equation (2) is solved, it can be seen that q(t) can be expressed by the following exponential function regarding t:

$$q(t)=CE(1-\exp(-t/RC)) \tag{3}$$

Furthermore, assuming the voltage across both ends of the capacitor as ec(t), since q(t)=C·ec(t), it can lead to the relation:

$$ec(t)=E(1-\exp(-t/\tau)) \quad (4)$$

(where $\tau$=RC)

The product of R and C is a time constant $\tau$ of the circuit. Accordingly, assuming the resistance of the toner as R and the static capacitance of the toner as C, the product RC is defined as the time constant $\tau$ of the toner. According the equation (4), as $\tau$ is larger, the time in which ec(t) reaches the maximum value E takes longer. Since the time constant $\tau$ is in proportion with values for the resistance R and the static capacitance C of the toner, as the resistance of the toner or the amount of electric charges induced to the capacitive ingredient of the toner is larger, charging for the toner requires longer time. That is, rise of triboelectric charging of the toner is delayed.

For determining the time constant $\tau$, an AC square wave is applied to the circuit instead of turning on and off of the DC power. Actually, the resistance (R) and the capacitance (C) of the toner were measured by using a dielectric loss measuring apparatus (TRS-10T model, trade name of products manufactured by Ando Denki Co.), to determine the time constant $\tau$.

In the developing toner for electrostatic latent images according to the invention, the coloring resin particle contains a binder resin and an inorganic pigment.

The binder resin contains (a) polyester resin, (b) polyalkylene, (c) polyolefin dispersant and (d) non-oxidized polyethylene resin.

(a) Polyester Resin

The polyester resin used in the invention is a polycondensation product of a basic acid and a polyhydric alcohol. As the basic acid, those used customarily for the preparation of the polyester resin can be used and include, for example, maleic acid, maleic acid anhydride, fumaric acid, citraconic acid, itaconic acid, methaconic acid, phthalic acid anhydride, isophthalic acid, terephthalic acid, succinic acid anhydride, adipic acid, azelaic acid, sebasic acid, tetrahydro phthalic acid anhydride, hexahydro phthalic acid anhydride, tetrabromo phthalic acid anhydride, tetrachrolo phthalic acid anhydride, HET acid anhydride, endomethylene tetrahydro phthalic acid anhydride, trimellitic acid, trimellitic acid anhydride, pyromellitic acid, and pyromellitic acid anhydride. Among them, aromatic dicarboxylic acids are preferred with a view point of further improving the anti-blocking property of the toner. The polybasic acids can be used each alone, or two or more of them may be used in combination. Also for the polyhydric alcohol, those used customarily for the preparation of the polyester resin can be used and include, for example, ethylene glycol, propylene glycol, 1,3-butane diol, 1,4-butane diol, 1,3-butylene glycol, 1,6-hexane diol, 1,5-pentane diol, 1,6-pentane diol, diethylene glycol, dipropylene glycol, neopentyl glycol, triethylene glycol, hydrogenated bisphenol A, polyoxyethylenated bisphenol A, polyoxypropylenated bisphenol A, bisphenol dihydroxy propyl ether, glycol, and glycerin. Among them, diols are preferred also with the view point of further improving the anti-blocking property of the toner. The polyhydric alcohols can be used each alone or two or more of them can be used in combination.

The polyester resin can be synthesized, for example, by conducting dehydrating condensation reaction or an ester transformation reaction in an organic solvent containing a polybasic acid and a polyhydric alcohol under the presence of a catalyst. As the organic solvent, a solvent capable of dissolving or dispersing the polybasic acid and the polyhydric alcohol and inert to the dehydrating condensation reaction and the ester transformation reaction can be properly selected and used. As the catalyst, esterifying catalysts or an ester transforming catalyst used customarily for the synthesis of polyester resins can be used and include, for example, magnesium acetate, zinc acetate, lead acetate, antimony trioxide, etc. The catalysts can be used each alone or two or more of them can be used in combination. While the reaction temperature is not restricted particularly, it is preferably from 150 to 300° C.

While the polyester resin may be ether a saturated polyester resin or an unsaturated saturated polyester resin, the unsaturated polyester resin is preferred.

Preferably, the polyester resin has an acid value of from 15 to 30 mg KOH/g according to JIS K0070-1966 and a hydroxyl value of from 4 to 17 mg KOH/g according to JIS K0070-1916. The acid value means the number of terminal carboxyl residues of a polyester resin, while the hydroxyl value means the number of terminal hydroxyl group residues of the polyester resin. By controlling the acid value within the range described above, the anti-offsetting property and the negative chargeability of the toner according to the invention can be improved further. The acid value can be controlled by using, as the basic acid, a polybasic acid (maleic acid anhydride, trimellitic acid anhydride, etc.) in combination with a dibasic acid. Specifically, maleic acid anhydride and trimellitic acid anhydride may be used each by about 1 to 5 mol % based on the entire amount of the monomer compound respectively. Furthermore, since the hydrophobic property of the toner according to the invention is lowered by the use of the polyester resin with the hydroxyl value being controlled to the range described above, the toner of the invention shows excellent charge stability even under a high temperature and high humidity circumstance. The hydroxyl value can be controlled, for example, by decreasing the number of hydroxyl groups in accordance with a usual method.

Preferably, the polyester resin has a glass transition temperature (Tg) of from 55 to 65° C. according to ASTM D 3418-82. The anti-blocking property, the anti-offsetting property, etc. of the toner according to the invention can be further improved by the use of the polyester resin with the glass transition temperature being within the range described above.

Preferably, the polyester resin has a melt index (MI) of from 0.1 to 6.0 g/10 min. Since the compatibility with the polyalkylene as the wax ingredient is further improved and the polyalkylene is dispersed uniformly in the polyester resin by using the polyester resin described above, various characteristics of the toner according to the invention are further improved.

The polyester resin preferably has a number average molecular weight (Mn) of from 5200 to 7000 and, more preferably, from 5700 to 6400 according to the GPC measuring method. By controlling the number average molecular weight to the range described above, favorable images of excellent image reproducibility can be formed, particularly, in a case of recording or copying images at low density (for example, images at 1% character area ratio) for a long period of time. The case of recording or copying images at low density for a long period of time is, for example, such a case as recording or copying by a facsimile mode in facsimile units or multi-function printers. In the invention, since the grain size of the toner can be reduced and the consumption amount per cycle of image formation is small, when the toner is once filled in a toner containing vessel in the developing device of an image forming apparatus, the amount for replacement of the toner is decreased and the toner in an over-agitated state increases. As a result, hydrophobic fluidizing particles on the surface of the toner are buried in the toner, and the flowability of the toner is lowered making the supply of the toner to electrostatic latent images insufficient to sometimes cause image failure such as ruggedness of the images. The roughening is such an image failure that half tone images are observed as if they were rugged by fine unevenness of density. In a case where the number average molecular weight is less than 5200, burying of the hydrophobic fluidizing particles in the toner can not be prevented sufficiently to possibly cause ruggedness. Furthermore, in case where the number average molecular weight exceeds 7000, the fixing property of the toner is deteriorated.

The polyester resin preferably has 4 mm lowering temperature of 160 to 175° C. according to a flow tester equi-temperature elevation rate method (6° C./min, load: 20 kg, die: 1 mm×0.5 mmϕ, apparatus: CFT500, trade name of products manufactured by Shimazu Seisakusho Co.). The fixing property, the anti-offsetting property, etc. of the toner can be improved further by controlling to the range described above.

Various physical properties of the polyester resin can be set to desired ranges by properly selecting, for example, kinds, blending ratio, reaction temperature, reaction time of the basic acid and the polyhydric alcohol as the monomer compounds, and the kind of the catalyst.

While the content of the polyester resin in the toner according to the invention can be selected properly in accordance with the kind of the polyester resin per se and the kind of other ingredients, it is, preferably, from 67 to 95% by weight and, more preferably, from 85 to 90% by weight based on the entire amount of the toner according to the invention.

In the invention, one or more of alkyd resin, polyolefin resin such as polyethylene terephthalate and polybutylene terephthalate, and polyallylate may be used together with the polyester resin as the main ingredient of the binder resin within a range not deteriorating the preferred characteristics of the developing toner for electrostatic latent images according to the invention.

(b) Polyalkylene

The polyalkylene is used, for example, for improving the anti-offsetting property of the developing toner for electrostatic latent images according to the invention.

As the polyalkylene, those used customarily so far for the improvement of the physical properties of the polyester resin as the toner binder resin can be used and include, for example, waxes such as paraffins and olefins. More specifically, they include, for example, polyethylene wax, polypropylene wax, polybutene wax, ethylene-propylene copolymer wax, and ethylene-butene copolymer wax. Among them, the polyethylene wax is preferred with a view point of improving the fixing property at a low temperature and the polypropylene wax is preferred with a view point of further improving the anti-offsetting property.

Furthermore, a non-oxidized polypropylene can also be used as the polyalkylene. The polyalkylenes may be used each alone or, optionally, two or more of them can be used in combination.

While the amount of the polyalkylene used can be properly selected in accordance with the kind of the polyester resin, the kind of the polyalkylene per se, and the kind and the amount of use of other ingredients and the amount of use thereof, it is, preferably, from 0.2 to 20 parts by weight and, more preferably, from 1 to 8 parts by weight based on 100 parts by weight of the polyester resin. In a case where it is less than 0.2 parts by weight, the effect of improving the anti-offsetting property is insufficient. On the other hand, if it greatly exceeds 20 parts by weight, not only improvement for the anti-offsetting property is insufficient, but this may cause fusion to a photoreceptor and/or deposition to a carrier used in combination with the toner to possibly cause image failure.

(c) Polyolefin Dispersant

The polyolefin dispersant contributes, for example, to the dispersion of the polyalkylene into the polyester resin.

The polyolefin dispersant includes, for example, a graft polymer formed by graft polymerizing a styrenic polymer chain and/or styrene-(meth)acrylic polymer chain to a polyolefin resin, styrene-(meth)acrylic polymer, etc.

The polyolefin resin includes herein, for example, polyethylene, polypropylene, polyethylene terephthalate and polybutylene terephthalate. Among them, polyethylene, polypropylene, etc. are preferred. Furthermore, non-oxidized polyethylene, non-oxidized polypropylene, etc. can also be used. The polyolefin resins can be used each alone or two or more of them can be used in combination.

The styrenic polymer includes, for example, polystyrene homopolymer, hydrogenated styrene resin, styrene-isobutylene copolymer, styrene-butadiene copolymer, acrylonitrile-butadiene-styrene terpolymer, acrylonitrile-styrene-acrylic acid ester terpolymer, styrene-acrylonitrile copolymer, acrylonitrile-acrylic rubber-styrene terpolymer, acrylonitrile-chlorinated polystyrene-styrene terpolymer, acrylonitrile-EVA-styrene terpolymer, styrene-p-chloro styrene copolymer, styrene-propylene copolymer, styrene-butadiene rubber, styrene-maleic acid ester copolymer, styrene-isobutylene copolymer, and styrene-maleic acid anhydride copolymer. The styrenic polymers can be used each alone or two or more of them can be used in combination.

The styrene-acrylic polymer includes, for example, styrene-acrylic acid copolymer, styrene-methyl methacrylate copolymer, styrene-ethyl methacrylate copolymer, styrene-butylmethacrylate copolymer, styrene-methyl acrylate copolymer, styrene-ethyl acrylate copolymer, and styrene-acrylic acid-maleic acid anhydride copolymer. Furthermore, in the invention, polyvinyl chloride, polyvinyl acetate, etc. are also included in the styrene-acrylic polymer. The styrene-acrylic polymers may be used each alone or two or more of them can be used in combination.

The graft polymer can be obtained, for example, by dissolving or dispersing a polyolefin resin into an aromatic hydrocarbon such as toluene or xylene or like other appropriate solvent, and dropping thereto monomer compounds constituting a styrenic polymer or styrene-acrylic polymer and a polymerization initiator under heating at 100 to 200° C. As the polymerization initiator, known initiators can be used including, for example, benzoyl peroxide, di-tert-butyl peroxide and tert-butyl per oxybenzoate. While the amount of the polymerization initiator to be used is not particularly limited, it is preferably from 0.2 to 10% by weight based on the entire amount of the monomer compounds.

The polyolefin dispersants can be used each alone or two or more of them can be used in combination.

While the amount of the polyolefin dispersant to be used can be properly selected in accordance with the kind and the amount of use of other ingredients, particularly, the polyalkylene, it is, preferably, from 0.2 to 5.0 parts by weight and, more preferably, 0.5 to 3.0 parts by weight based on 100 parts by weight of the polyester resin. In a case where it is less than 0.2 parts by weight, dispersion of the polyalkylene into the polyester resin may possibly become insufficient. On the other hand, if it greatly exceeds 5.0 parts by weight, dispersion may become excessive to lower the effect of dispersing the polyalkylene into the polyester resin to possibly cause fixing offset.

(d) Non-oxidized Polyethylene

As the non-oxidized polyethylene, known materials can be used. Furthermore commercial products can also be used.

While the amount of the non-oxidized polyethylene to be used can be selected properly in accordance, for example, with the kind and the amount of use of other ingredients, it is, preferably, from 0.5 to 5.0 parts by weight and, more preferably, from 0.8 to 3.0 parts by weight based on 100 parts by weight of the polyethylene resin. In a case where it is less than 0.5 parts by weight, the effect of adding the non-oxidized polyethylene becomes insufficient to possibly make the dispersion of the polyalkylene in the polyester resin not uniform. In a case where it greatly exceeds 5.0 parts by weight, dispersibility of the non-oxidized polyethylene per se is lowered and the addition effect thereof can not possibly be provided sufficiently.

The conductive inorganic pigment contained in the coloring resin particles has a role as the colorant, and enhances the hiding power of the toner to the recording material and, further, can control the time constant of the toner according to the invention by properly selecting the amount of use thereof.

While the reason why the time constant of the toner can be controlled depending on the amount of the inorganic pigment to be used is not apparent sufficiently, it may be considered that since the inorganic pigment comprises a metal oxide or carbonaceous material such as carbon black having a conductivity, when the inorganic pigment is dispersed in the toner, the inorganic pigment forms electrodes to develop the characteristics like a capacitor between adjacent inorganic pigments, and a conduction path is formed at a portion where the inorganic pigments are in contact with each other continuously to change the resistance and hence the time constant $\tau$ (=RC) of the toner.

While a method of increasing the acid value of the polyester resin may be mentioned as one of methods of controlling the time constant in addition to the selection for the amount of the inorganic pigment to be used, when the acid value is increased, a great amount of hydroxyl groups (COOH, OH) are present in the molecular chains of the polyester resin, to remarkably lower the charged amount of the toner under a high humidity circumstance, which brings about scattering of the toner in the image forming apparatus to cause background fogging or the like. Accordingly, since the inorganic pigment also has a merit capable of enhancing the hiding power of the toner in addition to the control for the time constant as described above, it is preferred to control the time constant based on the amount of the inorganic pigment to be used.

As the inorganic pigment, those used customary in this field can be used and include, for example, various kinds of carbon blacks manufactured by a thermal black method, an acetylene black method, a channel black method, a furnace black method and a lamp black method, and aniline black, copper oxide, tri-iron tetra oxide, and activated carbon. Among them, carbon black is preferred since it has high conductivity and can easily control the time constant within the predetermined range. The inorganic pigments can be used each alone or two or more of them can be used in combination.

While the amount of the inorganic pigment to be used can be properly selected in accordance, for example, with the kind of the inorganic pigment per se, it is, preferably, from 5 to 20 parts by weight, more preferably, from 7 to 15 parts by weight based on 100 parts by weight of the polyester resin. In a case where it is less than 5 parts by weight, the time constant exceeds 350 msec, the toner charging rate (rise of charge) is retarded to possibly cause scattering of the toner or background fogging in the image forming apparatus. Furthermore, the image density of images obtained by the toner according to the invention may be possibly lowered. In a case where it greatly exceeds 20 parts by weight, while rise of charges of the toner is fast and it shows favorable chargeability, the fixing property of the toner may possibly be deteriorated.

The coloring resin particles can be incorporated, in addition to the essential ingredients described above, with one or more of members selected, for example, from negative charge controller, positive charge controller, wax other than polyalkylene, colorant other than the inorganic pigment, and magnetic powder, within a range not deteriorating the preferred characteristics of the developing toner for electrostatic latent images according to the invention.

As the negative charge controller, those customarily used in this field can be used and, among them, chromium complex compounds are preferred. Known chromium complex compounds having the negative charge controlling effect can be used and those having, for example, the following chemical structure (1) may be used:

(1)

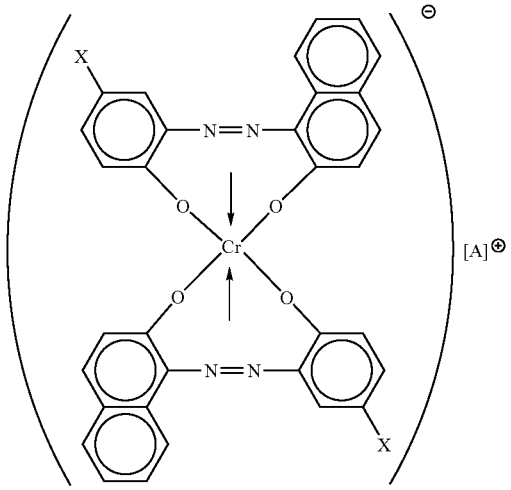

[Where X represents $Cl^-$, $Br^-$, $—SO_2NH_2$, $—SO_2CH_3$ or $—SO_2C_2H_5$, $A^+$ represents a linear alkyl ammonium group of 8 to 16 carbon atoms or a branched alkyl ammonium group of 8 to 16 carbon atoms in which one hetero-atom may intervene in the carbon-carbon bond] can be used.

In the chemical structural formula (1) above, the linear alkyl ammonium group of 8 to 16 carbon atoms represented by the reference $A^+$ includes, for example, $NH_3^+C_{12}H_{25}$, $NH_3^+C_{14}H_{29}$, etc.

In the branched alkyl ammonium group of 8 to 16 carbon atoms represented by reference $A^+$ in which one hetero-atom may intervene in the carbon-carbon bond, the hetero-atom includes, for example, those atoms capable of forming a polyvalent ions such as nitrogen atom, oxygen atom, sulfur atom, etc. Among them, the oxygen atom is preferred. Specific examples of the branched alkyl ammonium group include, for example, $NH_3^+C_3H_6OC\ (C_2H_5)HC_4H_9$, $NH_3^+C_3H_5OCH_2C\ (C_2H_5)HC_4H_9$, etc.

The negative charge controllers can be used each alone or two or more of them can be used in combination. While the amount of the negative charge controller to be used is not particularly limited and can be selected from a wide range, it is, preferably, from 0.5 to 5.0 parts by weight and, more preferably, from 1 to 3 parts by weight based on 100 parts by weight of the polyester resin.

As the positive charge controller, those used customarily in this field can be used and include, for example, nigrosine series dyes, pyridinium salts, ammonium salts, and chelate compounds thereof. The positive charge controllers can be used each alone or two or more of them can be used in combination. While the amount of the positive charge controller to be used is not particularly limited and can be selected from a wide range, it is, preferably, from 0.05 to 5 parts by weight and, more preferably, from 0.1 to 0.3 parts by weight based on 100 parts by weight of the polyester resin.

Waxes other than the polyalkylene are used for further improving the fixing property of the toner according to the invention. As the waxes, those customarily used in this field can be used and include, for example, natural waxes such as montanate ester wax and carnauba wax, silicone type wax and fluorine type wax. The waxes may be used each alone or two or more of them can be used in combination.

As the colorants other than the inorganic pigment, those customarily used in this field can be used and include, for example, organic dyes or organic pigments such as of nitro type, stilbene azo type, diphenylmethane type, triphenyl methane type, methine type, thiazol type, anthraquinone type, imidamine type, azine type, oxazine type, thiazine type, sulfide dye type, indigoide type and phthalocyanine type. The colorants may be used each alone or two or more of them can be used in combination.

As the magnetic powers, those used customarily in this field can be used and include, for example, composite ferrite comprising iron, copper, zinc, nickel, cobalt, manganese, chromium elements etc. or ferrite. The magnetic powders can be used each alone or two or more of them can be used in combination.

As the hydrophobic fluidizing particles to be deposited on the surface of the coloring resin particles, those used customarily in this field can be used and include fluidizing particles, for example, of metal oxides such as silica, alumnina, titania, zirconia and tine oxide, resin powder such as fluorine resin powders, fatty acid metal salts such as zinc stearate, aluminum stearate and calcium stearate, and carbon black, which are subjected to a hydrophobic treatment. The hydrophobic treatment can be applied by known methods, for example, by mixing fluidizing particles and silane coupling agents such as silicone oil, modified silicone oil, silicon varnish, tetramethyl disilazane, organoalkoxy silanes, and organo chlorosilanes and depositing the silane coupling agent to the surface of the fluidizing particles. Among them, silica subjected to a hydrophobic treatment (hydrophobic silica) having a specific surface area of 90 to 240 $m^2/g$ are preferred and those with a specific surface area from 90 to 240 $m^2/g$ are more preferred. Sufficient flowability is applied even to a small sized toner by the use of hydrophobic fluidizing particles having a specific surface area of from 90 to 240 $m^2/g$. Provision of the flowability to the toner is due to the function of the fluidizing particles as a spacer. Air is interposed between the toner particles by the presence of the fluidizing particles to improve the flowability of the toner. In a case where the specific surface area is much less than 90 $m^2/g$, the spacer effect becomes insufficient and the amount of air interposed between the toner particles is decreased to possibly lower the flowability. Furthermore, in a case where it greatly exceeds 240 $m^2/g$, agglomeration occurs between the fluidizing particles to each other and the fluidizing particles are liberated from the coloring resin particles and the liberated fluidizing particles possibly cause image failures such as white spots in the images. The hydrophobic fluidizing particles can be used each alone or two or more of them can be used in combination.

The specific surface area of the hydrophobic fluidizing particles was measured as a BET specific surface area by using a model of "automatic specific surface area meter" manufactured by Nikkiso Co.

The grain size of the hydrophobic fluidizing particles is preferably from 7 to 30 μm.

The amount of the hydrophobic fluidizing particles to be used is, preferably, from 0.1 to 3.0 parts by weight based on 100 parts by weight of the coloring resin particles depending on the kind of the hydrophobic fluidizing particles, etc. In a case where it is less than 0.1 parts by weight, the spacer effect possibly becomes insufficient. In a case where it exceeds 3.0 parts by weight, suspended silica may be formed to possibly cause white spots in the images.

The developing toner for electrostatic latent images according to the invention can be prepared in accordance with known methods. For example, the developing toner for electrostatic latent images according to the invention can be prepared by mixing a polyester resin, a polyalkylene, a polyolefin dispersant and a non-oxidized polyethylene and, optionally, other internal additives (additives that can be added to the coloring resin particles) in an air flow mixer such as a Henschel mixer, super mixer, mechano mill or Q-type mixer, melt kneading the same by a kneader such as a twin-screw kneader or single screw kneader at a temperature of about 70 to 180° C., cooling to solidify the obtained kneading product, pulverizing the solidified product by an air type pulverizer such as a jet mill, optionally controlling the grain size thereby preparing coloring resin particles with a grain size of, preferably, from 3 to 15 μm and, more preferably, from 5 to 8 μm, mixing the coloring resin particles with external additives (hydrophobic fluidizing particles) and depositing the external additives to the surface of the coloring resin particles.

The developing toner for electrostatic latent images according to the invention can be used as a one-component developer and a two-component developer. In a case of use as the one-component developer, for example, as the non-magnetic toner, the toner can be supplied to electrostatic latent images on the surface of a photoreceptor by triboelectrically charging the toner by a developing sleeve using a blade and a fir blush thereby conveying the same being deposited on the sleeve.

Furthermore, in a case of use as the two-component developer, a carrier is used together with the developing toner for electrostatic latent images according to the invention and used as a developer. The carrier to be used together with the toner of the invention is not particularly restricted and those used customarily in this field can be used, and include that of single or composite ferrite comprising iron, copper, zinc, nickel, cobalt, manganese and chromium elements, or carrier core particles covered at the surface with a covering material. The covering material is properly selected in accordance with the ingredients contained in the toner and includes, for example, polytetrafluoroethylene, monochloro-trifuloroethylene polymer, polyvinylidene fluoride, silicone resin, polyester type resin, metal compounds of di-tertiary butyl salicylic acid, styrenic resin, acrylic resin, polyacid, polyvinylal, nigrosine, aminoacrylate resin, basic dyes and lakes thereof, fine silica powder and fine alumina powder. The coating materials may be used each alone or two or more of them can be used in combination. The average grain size of the carrier is from 10 to 100 μm and, preferably, from 20 to 50 μm.

The image forming method according to the invention has a feature in developing electrostatic latent emerges on an electrophotographic photoreceptor by using the developing toner for electrostatic latent images according to the invention in the electrophotographic image formation.

For example, images are formed on a recording material by exposing an electrophotographic photoreceptor by an exposing means to form electrostatic latent images on an electrophotographic photoreceptor, supplying the developing toner for electrostatic latent images of the invention subjected to a charging treatment to the electrostatic latent images thereby developing the toner as toner images, transferring the toner images by a method such as pressing to a recording material such as paper, OHP film, etc. and, further, fixing the toner images transferred to the recording material by a method such as heating and pressing to the recording material.

As the electrophotographic photoreceptor used herein, an organic photoreceptor drum having a photoconducting layer can be used preferably.

Then, the image forming apparatus according to the invention is to be described with reference to the drawings. FIG. 1 is a cross sectional view schematically showing the constitution for a main portion of an image forming apparatus 100 according to a first embodiment of the invention.

The image forming apparatus 100 records data (image information) such as images read by an image reading device or data (image information) from an equipment (for example, an image processing apparatus such as a personal computer) connected from the outside to the image forming apparatus 100 and outputs the same.

The image forming apparatus 100 comprises an image forming station 1, a recording material feeding station 2, an image fixing station 3 and a controlling station 4.

The image forming station 1 comprises a photoreceptor drum 5, a charging means 6 positioned so as to oppose the circumferential surface of the photoreceptor drum 5, an exposing unit 7, a developing unit 8, a transferring means 9, a cleaning unit 10 and a charge-elimination means 11.

The photoreceptor drum 5 comprises a circular cylindrical or circular post-shaped conductive substrate and a photoconducting layer formed on the surface of the conductive substrate not illustrated.

The charging means 6 comprises a contact type or non-contact type charger such as a charging roller and a charging charger and charges the circumferential surface of the photoreceptor drum 5 to predetermined polarity and potential.

The exposing unit 7 comprises a laser unit such as a semiconductor laser and exposes the circumferential surface of the photoreceptor drum 5 put in a charged state by the charging means 6 based on the image information transmitted from the controlling station 4 thereby writing electrostatic latent images to the circumferential surface.

The developing unit 8 supplies a developer containing a toner supplied from a developer supplementing container 13 to electrostatic latent images written to the circumferential surface of the photoreceptor drum 5 thereby visualizing the electrostatic latent images. Thus, toner images are formed on the circumferential surface of the photoreceptor drum 5.

The transferring means 9 comprises, for example, a transfer roller 12 and a not illustrated voltage applying means and applies a voltage to a recording material from the side of the transfer roller 12 thereby charging the recording material and, further, applies a pressure by the transfer roller 12 thereby transferring the toner images on the circumferential surface of the photoreceptor drum 5 to the recording material. The recording material is fed to the transferring means 9 by a recording material feeding means 2 to be described later in synchronization with exposure by the exposing unit 7.

The cleaning unit 10 comprises a cleaning blade, etc. made of a resilient material and transfers the toner images to the recording material and then removes the toner remaining on the circumferential surface of the photoreceptor drum 5.

The charge-elimination means 11 comprises a charge elimination lamp, etc. and eliminates electric charges on the circumferential surface of the photoreceptor drum 5 after cleaning.

In the image forming station 1, the circumferential surface of the photoreceptor drum 5 is uniformly charged by the charging means 6, to which exposure is conducted from the exposing unit 7 and electrostatic latent images are written. The electrostatic latent images are visualized by the developer supplied from the developing unit 8 and the toner images are formed to the circumferential surface of the photoreceptor drum 5. The toner images are transferred by the transferring means 9 to the recording material. After transfer, the photoreceptor drum 5 is cleaned undergoing removal of the residual toner by the cleaning unit 10 and elimination of electric charges by the charge-elimination means 11. A plurality of images can be formed by conducting the series of procedures repetitively.

The recording material feeding means 2 comprises a recording material containing tray 20, a pick-up roller 21, and a register roller 22. The recording material containing tray 20 is a tray for containing recording material such as common paper, color copy paper, OHP film, etc. The recording material is supplemented to the recording material containing tray 20 by drawing out the recording material containing tray 20 to the frontal side (operation side) of the image forming apparatus 100. The pick-up roller 21 separates the recording materials in the recording material containing tray 20 sheet by sheet and feeding them to the register roller 22. The register roller 22 successively feeds the recording materials to a portion between the photoreceptor drum 5 and the transferring means 9 in synchronization with exposure to the circumferential surface of the photoreceptor drum 5 by the exposing unit 7 in the image forming station 1.

According to the recording material feeding means 2, recording material contained in the recording material containing tray 20 is fed by way of the pick-up roller 21 and the register roller 22 to the image forming station 1.

The image fixing station 3 comprises a fixing device 30, a conveyor roller 31, a switching gate 32, a reversing roller 33 and a loading tray 34. The fixing device 30 comprises a fixing roller 35 and a press roller 36. In the fixing device 30, the material transferred with the toner images by the transferring means 9 of the image forming station 1 is passed between the fixing roller 35 and the press roller 36 to fix the toner images to the recording material by heating and pressing. Thus, images are formed (recorded) on the recording material. The conveyor roller 31 feeds the recording material formed with images by the fixing device 30 to the switching gate 32. The switching gate 32 switches the feeding path of the image-recorded recording material. By way of the switching gate 32, the image-recorded recording material is conveyed either to the reversing roller 33 or to a not illustrated relay conveying device or a recording material re-feeding conveying device. The relay conveying device and the recording material re-feeding conveying device are to be described later. The reversing roller 33 discharges the image-recorded recording material to the loading tray 34 in a case where the discharge tray for the recording material is set to the loading tray 34. On the other hand, in a case where both face image formation or post treatment is designated, the reversing roller 33 puts the image-recorded recording material therebetween and, in this state, discharges a portion of the recording material toward the loading tray 34 and then rotates backwardly to convey the recording material from the switching gate 32 to a not illustrated relay conveying device. In this case, the switching gate 32 is switched from the state indicated by a solid line to the state indicated by a broken line. The loading tray 34 is a tray disposed to the outside of the image forming apparatus 100 for discharging the image-recorded recording materials to the outside of the image forming apparatus 100 and storing them.

According to the image fixing station 3, toner images are fixed by the fixing device 30, the image-recorded recording material is conveyed by way of the conveyor roller 31 and the switching gate 32 to the reversing roller 33 and then discharged to the loading tray 34 or conveyed under reversion by way of the switching gate 32 again to the not illustrated relay conveying device or the recording material re-feeding conveying device.

The controlling station 4 is disposed in a vertical space of the exposing unit 7 inside the image forming apparatus 100 and comprises a circuit substrate for controlling the image forming process, an interface substrate for receiving image data from an the external equipment and a power supply device, each of which is not illustrated. The power supply device supplies power not only to the circuit substrate and the interface substrate but also to each of the devices in the image forming station 1, the recording material feeding station 2 and the image fixing station 3.

Conveying paths 37, 38, and 39 are provided on the lower surface and the lateral surface of the image forming apparatus 100. The conveying paths 37, 38, and 39 are utilized upon connection of an external device with the image forming apparatus 100 for conveying the recording materials into or out of the image forming apparatus 100.

According to the image forming apparatus 100, electrostatic latent images are written to the circumferential surface of the photoreceptor drum 5 based on the image formation inputted to the controlling station 4, and the electrostatic latent images are developed and transferred to the recording material and then fixed, which is then discharged to the loading tray 34 or served again to the image forming process.

Figure 2:
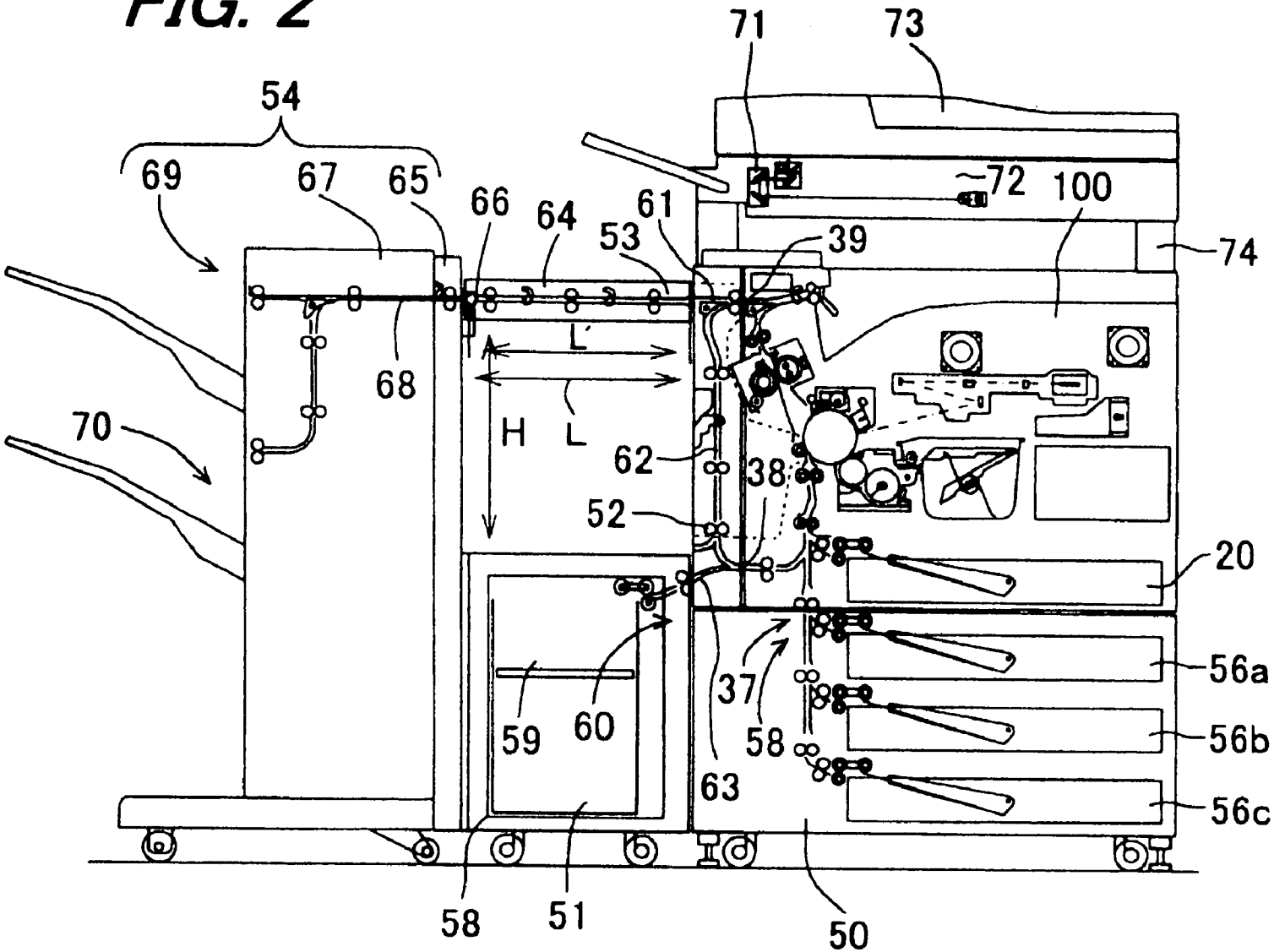
FIG. 2 is a side elevational view schematically showing the constitution of an image forming apparatus according to a second embodiment of the invention.

FIG. 2 is a side elevational view schematically showing the constitution of an image forming apparatus according to a second embodiment of the invention. The image forming apparatus of this embodiment comprises, to the outside of the image forming apparatus 100, a recording material feeding device 50, a recording material feeding device 51, a recording material re-feeding conveying device 52, a relay conveying device 53, a post processing device 54, and an image reading device 55. Explanation is to be omitted for the portions of the image forming apparatus 100.

The recording material feeding device 50 comprises recording material containing trays 56*a*, 56*b* and 56*c* and a feed path 57. The recording material containing trays 56*a*, 56*b*, and 56*c* contain recording materials of identical or different size. In a case of supplementing or replacing recording materials to or from the recording material containing trays 56*a*, 56*b*, and 56*c*, this is conducted by drawing out the recording material containing tray 56*a*, 56*b*, or 56*c* in the frontal direction of the recording material feeding device 52. While the recording material feeding device 50 comprises three recording material containing-trays 56*a*, 56*b*, and 56*c* in this drawing, it may be constituted with one or two or four or more recording material containing trays. The recording material feeding path 58 is connected at the upper surface of the recording material feeding device 50 with the conveying path 37 at the lower surface of the image forming apparatus 100, and feeds the recording materials fed from the recording material containing trays 56*a*, 56*b*, and 56*c* to the image forming apparatus 100. The recording material feeding device 50 selectively operates one of the recording material containing trays 56*a*, 56*b*, and 56*c* designated by a user and feeds the transfer material contained in the recording material containing tray 56*a*, 56*b*, or 56*c* by way of the feed path 57 to the image forming apparatus 100. Furthermore, the recording material feeding device 50 is also a unit having a function of desk for loading the image forming apparatus 100 and is made detachable to and from the image forming apparatus 100. According to the recording material feeding device 50, the recording material is handed by way of the feed path 57 to the conveying path 37 of the image forming apparatus 100 and reaches the image forming station 1.

The recording material feeding device 51 comprises a recording material containing tray 58, a recording material feeding means 59 disposed inside the recording material containing tray 58 and a feed path 60 provided to the upper lateral surface thereof. The recording material containing tray 58 can contain a greater amount of recording materials than the recording material containing trays 56*a*, 56*b*, and 56*c* in the recording material containing tray 20 in the image forming apparatus 100 and the recording material containing trays 56*a*, 56*b*, and 56*c* in the recording material feeding device 50. The recording materials are loaded on the recording material feeding means 59. The recording material feeding means 59 adjusts such that the uppermost portion of the recording materials loaded thereon situates to a position for the conveying path 60 by not illustrated driving means and sensors. The feed path 60 is connected with a feed path 63 disposed to the lower lateral surface of the recording material re-feeding conveying device 52 to be described later and, further connected with the conveying path 38 provided to the lower lateral surface of the image forming apparatus 100. According to the recording material feeding device 51, the recording materials contained in the recording material containing tray 58 are separated and fed by way of the feed path 60, the feed path 63, and the conveying path 38 to the image forming station 1.

The recording material re-feeding conveying device 52 comprises the feed paths 61, 62, and 63.

The feed path 61 is connected at one side to the conveying path 39 on the lateral surface of the image forming apparatus 100 at the upper lateral surface opposed to the image forming apparatus 100 and, at the other side, connected with the feed path 64 provided to the lateral surface of the relay conveying device 53 to be described later.

The feed path 62 is branched from the feed path 61 and, after joined with the feed path 63, connected with the conveying path 38 on the lateral surface of the image forming apparatus 100 at the lower lateral surface opposed to the image forming apparatus 100.

The feed path 63 is connected with the feed path 60 disposed to the upper lateral surface of the recording material feeding device 51 at the lower lateral surface opposed to the recording material feeding device 51.

The recording material re-feeding conveying device 52 either feeds the recording material conveyed under reversion by the reversing roller 33 in the image fixing station 3 of the image forming apparatus 100 by way of the feed path 61 to the relay conveying device 53 to be described later, or feeds the material by way of the feed paths 61 and 62 to the image forming apparatus 100 again. Feeding to the relay conveying device 53 is conducted in a case of applying the post treatment. Feeding to the image forming apparatus 100 again is conducted in a case of both face image formation. Furthermore, the recording material contained in the recording material feeding device 51 is fed by way of the feed path 62, 63 to the image forming apparatus 100.

The relay conveying device 53 is mounted at one end with the recording material re-feeding conveying device 52 and at the other end with the receiving and conveying portion 65 of a post processing device 54 to be described later respectively and supported rotationally around a rotation fulcrum 66 disposed to the conveying portion 65 as a center. Furthermore, a feed path 64 is provided at the inside and the feed path 64 is connected at one end thereof to the feed path 61 of the recording material re-feeding device 52 and connected at the other end thereof with the feed path 68 inside the post processing device 54.

The relay conveying device 53 is a device for feeding the image-formed recording material fed from the image forming apparatus 100 by way of the recording material re-feeding conveying device 52 to the post processing device 54.

The relay conveying device 53 is not necessarily disposed rotationally but it may be also a connection member (first positioning member) for connecting the image forming apparatus 100 and the post processing device 54.

The post processing device 54 is connected by way of the recording material re-feeding conveying device 52 and the relay conveying device 53 with the image forming apparatus 100, and comprises a receiving and conveying portion 65, a rotation fulcrum 66 disposed to the receiving and conveying portion 65, a post processing portion 67, a feed path 68 disposed so as to penetrate the receiving and conveying portion 65 and the post processing portion 67, a first recording material discharge portion 69 and a second recording material discharge portion 70.

The receiving and conveying portion 65 feeds the image-recorded recording material fed from the relay conveying device 53 by way of the feed path 68 to the post processing portion 67.

Although not illustrated, the post processing portion 67 can be provided with one or more of post processing means having a function of binding a predetermined number of recording materials by a stapler or the like (stapling function), a post processing means having a function of folding a recording material to a predetermined size (A4, B4 size, etc.), a post processing means having a function of aperturing holes for filing (punching function), a post processing means having a function capable of changing the discharging position within a range from several bins to several tens bins for conducting sorting or classification (sorter function), etc.

At the first recording material discharge portion 69, image-recorded recording materials are discharged being classified into plural portions by the sorter function of the post processing portion 67. Of course they may be discharged with no classification not utilizing the sorter function. At the second recording material discharge portion 70, the image-recorded recording materials are discharged after being applied with treatment such as stapling (binding with stapler), punching (hole aperturing for filing), etc. The discharge portion is selected by a user.

According to the post processing device 54, a desired post treatment is applied to the image-recorded recording material.

The image reading device 55 comprises a not-illustrated document platen, a light scanning unit 71 disposed below the document platen, an image pick-up device 72, an automatic document feeder 73, an image reading device support 74, and a not illustrated memory.

The document platen is constituted with a transparent material such as glass and disposed for loading an image-recorded original document.

The light scanning unit 71 is disposed such that it can move for scanning along the lower surface of the document platen, conducts exposure scanning to the images of the original document set to the document platen and transmits optical images thereof to the image pick-up device 72. The light scanning unit 71 scans and reads the original document images on the side below the document in the process of conveying the original document along the automatic document feeding path. The light scanning unit 71 guides optical images as far as the image pick-up device 72 to read original document images. Furthermore, in a case of reading both faces of the original document simultaneously, it can be constituted to mount a light source for exposing the original document on the side above the document, an optical lens for guiding optical images as far as the image pick-up device, a contact image sensor (CIS) including, for example, an image pick-up device for converting the optical images into image data to the automatic document feeder 73. In such a constitution, when the reading mode is set for reading both face original document, original documents set to the not illustrated feeding portion of the automatic document feeder 73 are conveyed successively and images on both surfaces of the original document are read substantially at the same time.

The image pick-up device 72 comprises a charge coupled device (CCD) image sensor, etc. which converts the optical images guided from the optical scanning unit 71 into image data.

The automatic document feeder 73 is a device for feeding documents located in the not illustrated feeding portion successively one by one to the document platen. The automatic document feeder 73 operates in a case where the image reading device 55 is set to an automatic reading mode. On the other hand, the image reading device 55 is also provided with a manual reading mode in addition to the automatic reading mode. The manual reading mode is a system of manually setting those original documents in which plural documents are collectively filed such as books and magazines and sheet-like original documents that can not be automatically fed by the automatic document feeder 73 to the document platen and reading the original document images.

The image reading device 55 exposes under scanning the images of the original document set on the transparent platen by the exposing unit 71 and focuses them on the image pick-up device 72, converts the original images into electrical signals, stores them in a memory and then outputs the same as the image data to the controlling station 4.

EXAMPLE

The invention is to be described specifically referring to synthesis examples, examples, comparative examples and testing examples. Hereinafter, "parts" means "parts by weight" unless otherwise specified.

Synthesis Example 1

Synthesis of Polyolefin Dispersant (a)

40 parts of xylene and 20 parts of non-oxidized polypropylene (softening point: 152° C., trade name of products: Viscol 550P, manufactured by Sanyo Kasei Industry Co.) were charged in an autoclave made of stainless steel and, after sufficient nitrogen substitution for the inside of the autoclave, the temperature was elevated up to 170° C. under tight sealing. While maintaining the temperature, a liquid mixture comprising 80 parts of styrene, 12 parts of n-butyl acrylate, 8 parts of methyl methacrylate, and one part of di-butyl peroxide was dropped for 4 hours and then they were further kept at 170° C. for one hour to obtain a xylene solution containing a graft polymer and a styrene (meth)acrylate resin. By distilling off xylene from the solution, a polyalkylene dispersant (a) was obtained.

Synthesis Example 2

Synthesis of Polyolefin Dispersant (b)

50 parts of toluene and 25 parts of non-oxidized polyethylene (softening point: 120° C., trade name of products: PE130, manufactured by Clariant Japan Co.) were charged in an autoclave made of stainless steel and the temperature was elevated up to 110° C. under a normal pressure in the autoclave to reflux toluene. While maintaining the temperature, a liquid mixture comprising 83 parts of styrene, 17 parts of 2-ethylhexyl acrylate, 0.5 parts of divinyl benzene and one part of benzoyl peroxide was dropped for 2 hours and then they were further kept at 110° C. for one hour to obtain a toluene solution containing a graft polymer and a styrene acrylate resin. By distilling off toluene from the solution, a polyalkylene dispersant (b) was obtained.

Synthesis Example 3

Synthesis of Polyolefin Dispersant (c)

A polyolefin dispersant (c) was obtained in the same manner as in Synthesis Example 1 except for using 12 parts of non-oxidized polyethylene (PE-130) and 8 parts of non-oxidized polypropylene (Viscol 550P) instead of 20 parts of non-oxidized polypropylene (Viscol 550P).

Example 1

Polyester resin (acid value: 25, hydroxyl value 11, manufactured by Sanyo Kasei Industry Co.) 100 parts Polyolefin dispersant (a) 3 parts Negative charge controller (trade name of products:Aizen Spilon Black TRH, manufactured Hodogaya Chemical Industry Co.) 1.5 parts Carbon black (trade name of products: MA77, manufactured by Mitsubishi Chemical Co.) 10 parts Non-oxidized polypropylene (Viscol 550P)] 3 parts Non-oxidized polyethylene (PE-130) 3 parts Each of the ingredients described above was mixed at the ratio described above and, after melt kneading by a twin-screw extruder, cooled and pulverized to obtain toner particles of an average grain size of 6.3 μm (coloring resin particles).

2.8 parts by weight of hydrophobic silica (trade name of products: R976S, specific surface area: 110 $m^2/g$, manufactured by Nippon Aerosil Co.) were admixed with 100 parts of the toner particles, to obtain a toner of Example 1.

Example 2

A toner of Example 2 was obtained in the same manner as in Example 1 except for changing the polyester resin, carbon black and hydrophobic silica in Example 1 to those described below and changing the amount of the non-oxidized polyethylene (PE-130) to be used to 5 parts. The average grain size of the toner particles (coloring resin particle) was 6.7 μm.

Polyester resin (acid value: 20, hydroxyl value: 17 manufactured by Sanyo Kasei Industry Co.) 100 parts Carbon black (MA-100S, manufactured by Mitsubishi Chemical Co.) 20 parts Hydrophobic silica (name of products: HDK H2000, specific surface area: 140 $m^2/g$, manufactured by WACKER Co.) 2.2 parts Example 3

A toner of Example 3 was obtained in the same manner as in Example 1 except for changing the polyester resin and the hydrophobic fluidizing particles to those described below, and changing the amount of the carbon black (MA-77) to be used to 5 parts and the amount of the non-oxidized polyethylene (PE-130) to be used to 0.8 part in Example 1. The average grain size of the toner particles (coloring resin particle) was 7.2 μm.

Polyester resin (acid value: 15, hydroxyl value: 4 manufactured by Sanyo Kasei Industry Co.) 100 parts Hydrophobic silica (Trade name of products: R812S, specific surface area: 220 $m^2/g$, manufactured by Nippon Aerosil Co.) 0.6 parts Example 4

A toner of Example 4 was obtained in the same manner as in Example 1 except for changing the hydrophobic fluidizing particles to those described below.

A toner of Example 4 was obtained in the same manner as in Example 1 except for using 1.2 parts of hydrophobic silica (name of products: HDK H3004, specific surface area: 200 $m^2/g$, manufactured by WACKER Co.).

Comparative Example 1

A toner of Comparative Example 1 was obtained in the same manner as in Example 1 except for changing the polyester resin and the hydrophobic fluidizing particles to those described below and changing the amount of carbon black (MA-77) to be used to 4 parts in Example 1.

Polyester resin (acid value: 32, hydroxyl value: 18 manufactured by Sanyo Kasei Industry Co.) 100 parts Hydrophobic silica (trade name of products: RX50, specific surface area 50 $m^2/g$, manufactured by Nippon Aerosil Co.) 4.0 parts Comparative Example 2

A toner of Comparative Example 2 was obtained in the same manner as in Example 1 except for changing the polyester resin, carbon black and hydrophobic fluidizing particles in Example 1 to those shown below.

Polyester resin (acid value: 10, hydroxyl value: 13 manufactured by Sanyo Kasei Industry Co.) 100 parts Carbon black (MA-100S) 28 parts Fluidizing particles (trade name of products: 300, specific surface area: 300 $m^2/g$, manufactured by Nippon Aerosil Co.) 0.1 parts Comparative Example 3

A toner of Comparative Example 3 was obtained in the same manner as in Example 1 except for changing the polyester resin, carbon black and hydrophobic fluidizing particles in Example 1 to those described below.

Polyester resin 6 (acid value: 20, hydroxyl value: 3 manufactured by Sanyo Kasei Industry Co.) 100 parts Carbon black (MA-77) 3 parts Hydrophobic silica (trade name of products: R812, specific surface area: 260 $m^2/g$, manufactured by Nippon Aerosil Co.) 0.3 parts Testing Example 1

Using toners of Examples 1 to 4 and Comparative Examples 1 to 3, actual copying test was conducted by an equipment modified from a digital copying machine (trade name of products: AR-5-5, manufactured by Sharp Corp.) under a normal temperature (temperature of 20° C. and relative humidity of 65%) circumstance and the following evaluation was conducted. Domestic paper was used for the paper to be used for copying. The results are shown in Table 1. Table 1 shows the acid value, the hydroxyl value and the glass transition temperature (Tg, ° C.) of the polyester resin, and the amount of use and the specific surface area of the hydrophobic fluidizing particles together.

[Image Density]

Actual copying test for 80,000 sheets of paper was conducted (original document at 6% character area ratio used), and the image density was measured by using an image density measuring instrument (trade name of products: PROCESS MEASUREMENTS RD914, manufactured by Macbeth Co.) and evaluated as "O" for those of 1.35 or more and as "x" for those of less than 1.35.

[Blow-Off Charged Amount (μC/g)]

Copying test for 80,000 sheets of paper was conducted (original document at 6% character area ratio used), a toner was sampled from the developing device on every 5,000 sheets of actually copied paper, and measurement was conducted by using a powder charged amount measuring apparatus (trade name of products: TB-200, manufactured by Toshiba Chemical Co.)

[Possible Number of Copy Sheet]

1400 g of a toner was filled in a developing device of AR-505 and the number of sheets of paper that could be copied was examined. Then, the residual amount (g) of the toner in the toner containing vessel was examined.

The possible number of copy paper was evaluated as "O" for those of 70,000 sheets or more and as "x" for those of less than 70,000 sheets.

Since the amount of the toner remained in the toner containing vessel increases as the flowability was poor, the residual amount of the toner was used as the index for the flowability and the residual amount (g) of the toner in the toner containing vessel was evaluated as "O" for those of less than 20 g and as "x" for those in excess of 20 g.

[Photoconducting Layer Grinding Property]

After the actual copying test for 80,000 sheets of paper (original document at 6% character area ratio used), the photoreceptor was taken out, the residual ratio of the photoconducting layer on the surface of the photoreceptor was examined and the grinding property of each toner for the photoconducting layer was evaluated. NECOSA paper of 8.5 inch×10 inch was used for the paper to be used for copying.

The residual ratio of the photoconducting layer was expressed by the percentage of the film thickness relative to the initial film thickness of the photoconducting layer after actual copying for 80,000 sheets. For the measurement of the film thickness after actual copying for 80,000 sheets of paper, a spectrophotometer of about 10 mm outer diameter and having plural light projecting and receiving optical fibers (trade name of products: MCPD-1100, manufactured by Otsuka Denshi Co.) was used. The spectrophotometer was located at a place spaced by about 2 mm in the vertical direction from a photoreceptor in the form of a cylindrical substrate. The light irradiation diameter in this case was about 3 mm. The measuring wavelength for the film thickness was set to 500 to 650 nm. The reflection spectrum was measured and the film thickness (μm) was determined. It was evaluated for the residual ratio as "O" for those of 80% or more and as "x" for those of less than 80%.

[Fixing Property]

Using a digital copying machine (AR-505) in which the fixing station was modified such that the temperature could be controlled, the fixing property was examined and the anti-offsetting property was evaluated. Domestic paper was used as the paper to be used for copying. Evaluation was given as "O" in a case where the offset occurrence temperature was 140° C. or lower on the low temperature side and the offset occurrence temperature was 220° C. or higher on the higher temperature side. Evaluation was given as "x" in the other cases.

[Toner Agglomerating Property]

1400 g of the toner was filled in the toner containing vessel, left in a high temperature tank at 50° C. for 48 hours, then 150 g of the toner was taken out of the toner containing vessel, placed to a 325 mesh (opening: 45 μm) metal manufactured by IIDA MANUFACTURING CO LTD and, after shaking by a low tap sieve shaker (manufactured by Nara Kikai Seisakusho Co.) for 2 min, the residual amount (g) of the toner on the mesh was measured. In a case where the residual amount of the toner was less than 2.0 g, the agglomeration property was low and it was judged as "O". In a case where it exceeded 2.0, the agglomeration property was high and evaluated as "x".

[Scratch Resistance (Fixing Ratio to Scratch)]

A scratch resistance of solid black images was examined. In a case where the scratch resistance is favorable, it means that paper jam due to fixing failure of solid black images less occurs. Evaluation was conducted as in (i) to (iii) below.

(i) Using a digital copying machine (Ar-505), solid black images of 30 m square were recorded on NECOSA paper at 8.5 inch×11 inch size and image density was measured (image density A). Domestic paper was used as paper to be used for copying.

(ii) NECOSA paper was bonded to the bottom of a circular weight (400 g) of 50 mm diameter and, after rubbing solid black images of 30 mm square for five reciprocation strokes such that the surface of the weight on the side of the NECOSA paper was in contact with the solid black images of 30 mm square, the image density of the images was measured (image density B).

(iii) The fixing ratio to scratch of the solid black images was calculated according to the following equation:

$$\text{Fixing ratio to scratch}(\%)=(\text{Image density } B/\text{image density } A)\times 100$$

The fixing ratio to scratch was evaluated as "O" for those of 90% or more, as "Δ" for those of less than 90% and 80% or more, and as "x" for those of less than 80%.

TABLE 1

| | | Example | | | | Comparative Example | | |
|---|---|---|---|---|---|---|---|---|
| | | 1 | 2 | 3 | 4 | 1 | 2 | 3 |
| Polyester resin | Acid value | 25 | 20 | 15 | 25 | 32 | 10 | 20 |
| | Hydroxyl value | 11 | 17 | 4 | 11 | 18 | 13 | 3 |
| | Tg/° C. | 57 | 68 | 47 | 57 | 57 | 68 | 47 |
| Hydrophobic fluidizing particles | Part | 2.8 | 2.2 | 0.6 | 1.2 | 4.0 | 0.1 | 0.3 |
| | Specific surface area $m^2/g$ | 110 | 140 | 220 | 200 | 50 | 300 | 260 |
| Image density | Measured value | 1.40~1.45 | 1.40~1.43 | 1.37~1.40 | 1.40~1.44 | 1.51~1.53 | 1.19~1.28 | 1.25~1.33 |
| | Evaluation | ○ | ○ | ○ | ○ | ○ | X | X |
| Blow-off charge amount | μC/g | 20~25 | 25~30 | 32~37 | 25~28 | 15~20 | 35~40 | 30~35 |
| Possible number of copy paper | Number of sheet | 70000 | 77000 | 85000 | 73000 | 50000 | 90000 | 86000 |
| | Evaluation | ○ | ○ | ○ | ○ | X | ○ | ○ |
| Residual toner amount | G | 8.0 | 12.2 | 16.7 | 10.0 | 38.6 | 24.6 | 32.1 |
| | Evaluation | ○ | ○ | ○ | ○ | X | X | X |
| Photoconducting layer grinding property | Residual ratio % | 95 | 97 | 96 | 98 | 78 | 62 | 56 |
| | Evaluation | ○ | ○ | ○ | ○ | X | X | X |
| Fixing property | Low temperature side ° C. | 130 | 125 | 140 | 130 | 120 | 125 | 105 |
| | High temperature side ° C. | 230 | 225 | 220 | 230 | 240 | 225 | 200 |
| | Evaluation | ○ | ○ | ○ | ○ | ○ | ○ | X |
| Scratch resistance | Fixing ratio & | 93 | 90 | 97 | 95 | 88 | 68 | 94 |
| | Evaluation | ○ | ○ | ○ | ○ | Δ | X | ○ |
| Toner agglomerating property | Residual amount g | 0.3 | 0.1 | 1.8 | 0.5 | 4.9 | 0.2 | 7.2 |
| | Evaluation | ○ | ○ | ○ | ○ | X | ○ | X |
| Time constant τ | Msec | 220 | 135 | 330 | 220 | 425 | 85 | 540 |
| Overall evaluation | | ○ | ○ | ○ | ○ | X | X | X |

From table 1, it is apparent that the developing toner for electrostatic latent images of the invention is an excellent toner capable of satisfying various performances required for the toner at high level.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing toner for electrostatic latent images comprising:

coloring resin particles containing a binder resin and carbon black; and hydrophobic fluidizing particles deposited on surfaces of the coloring resin particles, the binder resin containing a polyester resin, a polyalkylene selected from the group consisting of a paraffin wax, an oxidized polyethylene wax, a polypropylene wax, a polybutene wax, an ethylene-propylene copolymer wax, an ethylene-butene copolymer wax, and a non-oxidized polypropylene; a polyolefin dispersant and a non-oxidized polyethylene wax, in which the polyolefin dispersant is a polyolefin dispersant selected from a polyolefin resin having a side chain of a styrenic polymer chain or styrene (meth)acrylic polymer, wherein the amount of carbon black is 10 to 20 parts by weight based on 100 parts by weight of a polyester resin, the amount of the hydrophobic fluidizing particles having a specific surface area of from 110 to 200 $m^2/g$, are from 1.2 to 2.8 parts by weight based on 100 parts by weight of the coloring resin particles, and a time constant τ of the toner being from 135 to 220 msec, wherein the polyester resin consists of an unsaturated polyester resin which is synthesized from raw materials consisting of a polybasic acid and a polyhydric alcohol under the presence of a catalyst in an organic solvent, the polyester resin having an acid value of from 20 to 25 mg KOH/g and a hydroxyl value of from 11 to 17 mg KOH/g.

2. The developing toner for electrostatic latent images of claim 1, wherein the polyester resin has a glass transition temperature of from 57 to 68° C.

3. The developing toner for electrostatic latent images of claim 1, wherein the polyalkylene is contained in the coloring resin particles at a ratio from 0.2 to 20 parts by weight based on 100 parts by weight of the polyester resin.

4. The developing toner for electrostatic latent images of claim 1, wherein the non-oxidized polyethylene is contained in the coloring resin particles at a ratio from 0.5 to 5.0 parts by weight based on 100 parts by weight of the polyester resin.

5. An image forming method comprising using the developing toners for electrostatic latent images of claim 1 and recording images by an electrophotographic method to a recording material.

6. An image forming apparatus in which the developing toner for electrostatic latent images of claim 1 is used and images are recorded to a recording material by an electrophotographic method.

* * * * *